United States Patent [19]

Cho

[11] Patent Number: 4,887,078

[45] Date of Patent: Dec. 12, 1989

[54] DTMF-CODE CONTROLLED LOCK DEVICE

[76] Inventor: Jim Cho, 3rd Fl., No. 40, Alley 30, Lane 284, Wu-hsing St., Taipei, Taiwan

[21] Appl. No.: 190,367

[22] Filed: May 5, 1988

[51] Int. Cl.[4] ..... E04B 49/00

[52] U.S. Cl. ..... 340/825.48; 340/825.31; 340/825.71; 340/825.73; 340/825.76; 70/278; 379/102; 379/103; 379/105

[58] Field of Search ..... 379/102, 103, 104, 105, 379/106; 340/825.31, 825.48, 825.3, 825.54, 825.57, 542, 543, 825.71, 825.73, 825.74, 825.75, 825.76; 367/197, 199; 455/352, 354; 70/277, 278

[56] References Cited

U.S. PATENT DOCUMENTS

| | | | |
|---|---|---|---|
| 3,337,992 | 8/1967 | Tolson | 340/539 |
| 3,801,742 | 4/1974 | O'Brien et al. | 340/825.76 |
| 3,917,911 | 11/1975 | Lesher | 379/103 |
| 4,064,367 | 12/1977 | O'Malley | 379/104 |
| 4,083,424 | 4/1978 | von den Stenmen et al. | 70/278 |
| 4,113,986 | 9/1978 | Clement et al. | 379/103 |
| 4,408,251 | 10/1983 | Kaplan | 340/543 |
| 4,450,545 | 5/1984 | Kishi et al. | 340/825.31 |
| 4,602,256 | 7/1986 | Kago et al. | 367/197 |

FOREIGN PATENT DOCUMENTS

| | | | |
|---|---|---|---|
| 2163579 | 2/1986 | United Kingdom | 70/278 |

*Primary Examiner*—Donald J. Yusko
*Assistant Examiner*—Eric O. Pudpud
*Attorney, Agent, or Firm*—Ladas & Parry

[57] ABSTRACT

A DTMF-code controlled lock device mainly composed of tow units: a key control unit and a lock-body control unit. The key control unit, adapted to be carried by a user includes a dual-tone multifrequency (DTMF) encoding circuit with a keyboard and an amplifying circuit respectively connected thereto for inputting and outputting an unlocking DTMF code. The lock-body control unit, adapted to be installed in a door together with a door lock, includes a transducer for transferring the DTMF code signals received from the key control unit, a pair of amplifying circuits connected in series with the transducer, a decoder with its input connected to the amplifying circuits for decoding the DTMF signals into a BCD code, a CPU with a pair of memory units coupled with the output of the decoder for comparing the BCD code with pre-stored one therein, and a relay circuit coupled with the CPU in connection with the lock bolt for effecting unlocking operations upon being energized by the CPU if the comparison finds the two identical.

3 Claims, 3 Drawing Sheets

DTMF-CODE CONTROLLED LOCK DEVICE

BACKGROUND OF THE INVENTION

This invention relates to a code controlled lock device, and particularly to a dual-tone multifrequency (DTMF) code controlled lock device by which unlocking operation is effected through the transmission of pre-arranged DTMF codes so as to ensure complete security against unauthorized unlocking actions.

Conventional door locks, such as key-operated locks, combination locks, push-button locks, etc., suffer a common problem, i.e. the unlocking portions of the locks are all exposed on an outside surface of the door. These exposed portions of the locks are susceptible to unauthorized unlocking actions and to being wrecked by burglars. Therefore, security of the conventional locks cannot be ensured.

SUMMARY OF THE INVENTION

It is accordingly a primary object of the present invention to provide a DTMF-code controlled lock device that overcomes the foregoing problems associated with the prior art.

According to the present invention, this and other objects are achieved by the provision of a DTMF-code controlled lock device which comprises two main portions: a key control means having a structure adapted for being carried by a user and a lock-body control means adapted for being installed in a door together with a door lock. The key control means is composed of a DTMF encoding circuit serving as a central part and having a keyboard coupled therewith for inputting a preset unlocking DTMF code therefrom, an amplifying circuit connected thereto for amplifying the DTMF signals and producing a DTMF tone through a sound generating means coupled with the amplifying circuit, and a conductive cord electrically connected to the DTMF encoding circuit for being used to perform unlocking operations. The lock-body control means comprises: a transducing means adapted to be installed at a hidden place in a door for receiving the DTMF tone from the key control means; a pair of amplifying circuits connected in series to the transducing means for amplifying the DTMF signals; a telephone interface circuit coupled with one of the amplifying circuits for effecting unlocking operation through a key telephone set in case the key control means is not available; a decoding circuit coupled with the amplifying circuits for decoding the amplifed DTMF signals into BCD codes; a CPU with a plurality of memory units connected to the decoding circuit for receiving and identifying the BCD codes; and a pair of relay circuits respectively coupled with the CPU and the lock bolt for performing unlocking operations according to the controlling signal from the CPU; thereby, unlocking operations can be safely effected through the pre-arranged unlocking code input by the user so as to ensure complete security against unauthorized unlocking actions.

Other advantages and characteristics of the present invention will become clear from the following detailed description of a preferred embodiment when read in conjunction with the accompanying drawings.

DETAILED DESCRIPTION OF THE PREFERRED EMBODIMENT

Figure 1:
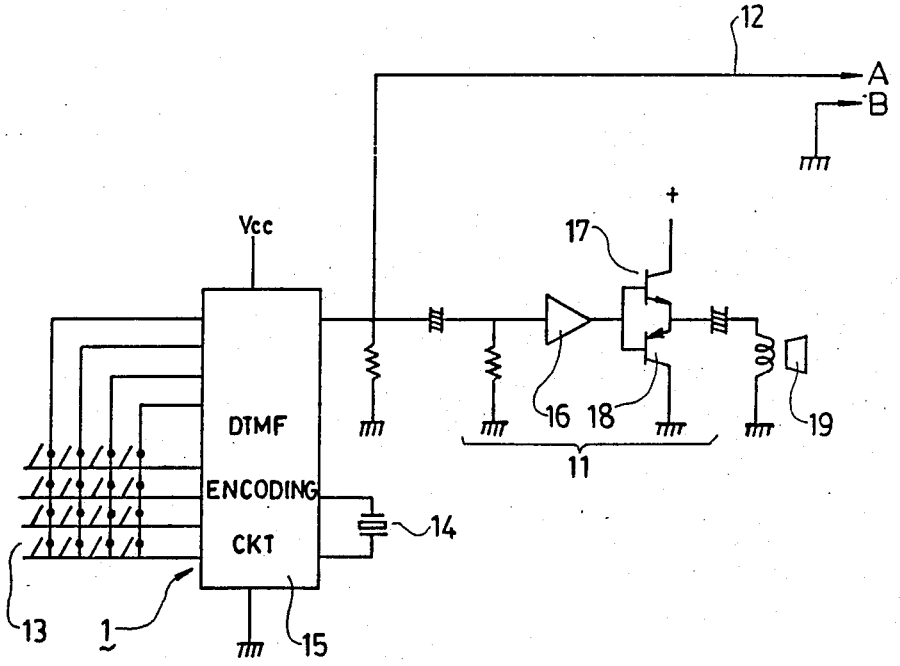
FIG. 1 is a circuit diagram of a key control means embodying the DTMF code controlled device according to this invention.
Figure 2:
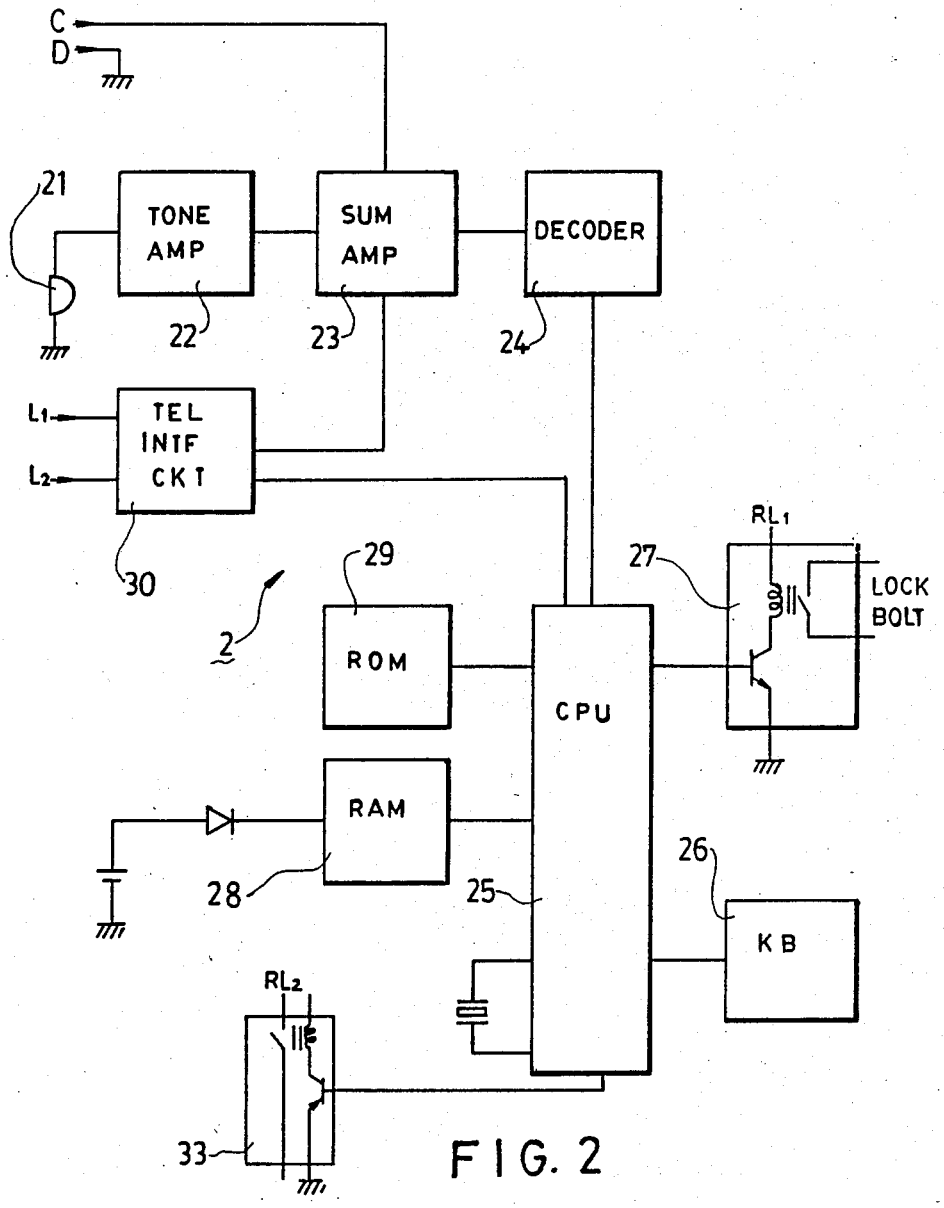
FIG. 2 is a block diagram of a lock-body control means embodying the DTMF code controlled device according to this invention.

Referring to FIGS. 1 and 2, the preferred embodiment of a DTMF-code controlled lock device according to this invention comprises a key control means 1 and a lock-body control means 2. The key control means 1 can be shaped as a case or an ornamental article for being carried along by a user, and can also be built as a unit for being installed at a proper place outside the door. As shown in FIG. 1, the key control means 1 is mainly composed of a dual-tone multifrequency (DTMF) encoding circuit 15; a first keyboard 13 with a plurality of keys, a quartz crystal oscillator 14 and an amplifying circuit 11 respectively coupled with the DTMF encoding circuit 15; a conductive cord 12 having a pair of terminals A and B provided at one end and electrically connected to the output of the DTMF encoding circuit 15; and a sound generator 19 electrically connected to the output of the amplifying circuit 11. When the pre-arranged code is keyed in at the first keyboard 13, the DTMF encoding circuit 15 will encode the keyed-in DTMF code into mixing signals with each digit of the DTMF code being combined of two frequencies and being fed into the amplifying circuit 11 where the mixed signals are then transferred into coded DTMF tones through an amplifier 16 and a pair of parallel-connected transistors 17 and 18 of the amplifying circuit 11 and produced by a sound generator 19 (it is to be noted that after the keyed-in code is encoded by the DTMF encoding circuit 15, each digit of the keyed-in code contains two different frequencies combined as DTMF signals so that no outside noise can interfere, and accordingly high security is achieved). The quartz crystal osicillator 14 is used to provide a stable reference frequency for the DTMF encoding circuit 15.

As shown in FIG. 2, the lock-body control means 2 includes: a transducer 21, such as a microphone, which can be installed at a hidden place of the door for receiving the DTMF sounds transmitted from the sound generator 19 during unlocking operatons; a tone amplifier 22 and a sum amplifier 23 connected in series with the transducer 21 for amplifying the DTMF signals supplied from the transducer; a pair of electrical contacts C and D, such as a socket, electrically connected to the input of sum amplifier 23 for making electrical connections with terminals A and B of the key control means 1 in performing unlocking operations in case the transducer 21 is out of order; a telephone interface circuit 30 electrically coupled with sum amplifier 23 for performing unlocking operations through a key telephone set connected to terminals L1 and L2 of the telephone interface circuit 30; a decoding 24 having its input connected to the output of the sum amplifier 23 for decoding the amplified DTMF signals into binary-coded decimal (BCD) codes and its output coupled with a CPU 25; a RAM 28 and a ROM 29 respectively connected to CPU 25 for identifying and comparing the BCD codes received from decoding circuit 24; a first relay circuit 27 electrically connected to CPU 25 in conjunction with the lock bolt of a door lock installed therein for effecting unlocking operatons according to a high level voltage supplied from CPU 25 if the BCD codes received from the decoder 24 are identical with the preset BCD codes stored in RAM 28; a second relay circuit 33 coupled between CPU 25 and a contact point 34 of the telephone interface circuit 30; and a second keyboard 26 with a plurality of keys coupled with CPU 25 for presetting or changing the unlocking DTMF codes by the user as the situation dictates.

The ROM 29 provided in the preferred embodiment of the lock-body control means 2 contains a preset program by which performance of a plurality of functions can be allowed in conjunction with the unlocking operations, namely:

(1) that the unlocking code can be preset with any combination of digits through the second keyboard 26;

(2) that a plurality of unlocking codes can be set for being used separately or duplicately by various persons;

(3) that the unlocking operation can be effected through a dial tone made on a remote key telephone set;

(4) that it can identify the unlocking code entered from the key control means 1, and that can effect a certain period of delay for processing the following unlocking code if the initial unlocking code is identified wrong; and (5) that the originally preset unlocking code can be changed or modified as required through the second keyboard 26.

Figure 3:
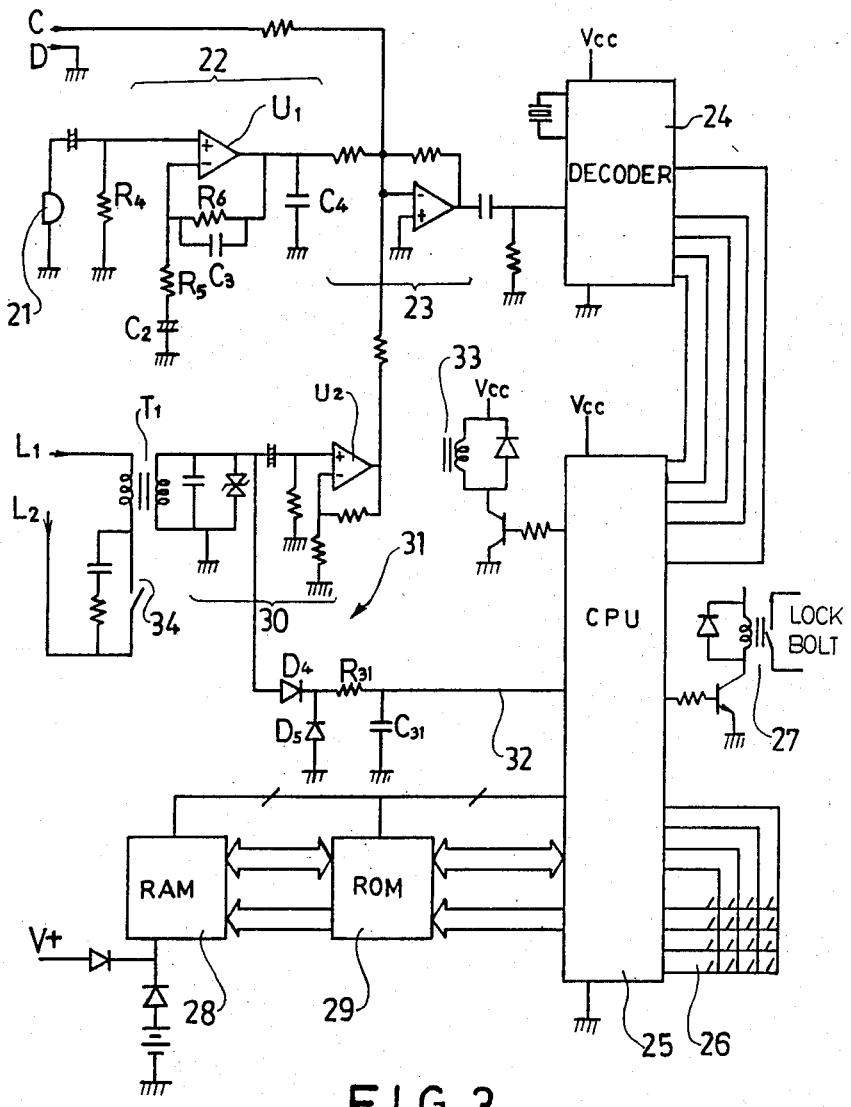
FIG. 3 is a circuit diagram of the lock-body control means shown in FIG. 2.

Referring to FIG. 3 in connection with FIG. 1, various unlocking operations of the preferred embodiment are as follows:

1. When an unlocking code is keyed in through the keyboard 13 of the key control means 1 by the user, the DTMF signals will be encoded into frequency mixing signals by the DTMF encoding circuit 15 and fed into the tone amplifying circuit 11 from which a different DTMF tone produced by the sound generator 19 will be received by the transducer 21 of the lock-body control means 2 and fed into the tone amplifier 22 for being amplified through an operation amplifier U1 thereof. Then, the different amplified DTMF signals are input into the sum amplifier 23 for being combined therein and fed into the decoding circuit 14 from which the combined DTMF signals are decoded into BCD code and fed into CPU 25 for being compared with the preset BCD codes stored in RAM 28. When the two kinds of BCD codes are compared and found to be identical, CPU 25 will output a high-level voltage to energize the first relay circuit 27 to attract the lock bolt of the door and effect unlocking operations. On the other hand, if the keyed-in unlocking code is compared and found to be unidentical with the stored preset code, no high-level voltage will be outputted from CPU 25 and the first relay circuit 27 will not be energized so that the door lock remains locked. In this condition, ROM 29 will effect a delay action of about 30 seconds. Within this delay time, any unlocking operations will not be effected for protecting the DTMF-code controlled lock device from being repeatedly tried by an unauthorized person who by chance has obtained the key control means 1.

2. In case the transducer 21 is out of order, just connecting the terminals A and B of the conductive cord 12 to the electrical contacts C and D of the lock-body control means 2 (such as that normally done with plug and socket), unlocking operations can be effected in like manner as that described in paragraph 1 above.

3. If the user forgets to take the key control means 1 along with him, and nobody stays in the user's house, unlocking operation can be effected through an outside key telephone set. As shown in FIG. 3 with reference to FIG. 2, the telephone interface circuit 30 is mainly composed of a transformer circuit T1 coupled with a key telephone set in the user's house through telephone lines L1 and L2 as well as a switch (not shown) provided between the telephone lines L1 and L2, an operation amplifier U2 connected with the sum amplifier 23 and a ringing signal detecting circuit 31 coupled with CPU 25. When the user keys in his home telephone numbers from an outside key telephone set, the ringing signals from a central office will be transferred into the ringing signal detecting circuit 31 through telephone lines L1 and L2 and relayed to CPU 25 through an input line 32 thereof. Upon receiving the ring signals from the ringing signal detecting circuit 31, CPU 25 will energize a second relay circuit 33 electrically connected with CPU 25 to attract contact point 34 thereof to close the receiving circuit of the telephone interface circuit 30 therein. As a result, the ringing signals are cut off (at this point, a 'tick' sound will be heard by the user through the receiver of his handset), and the user can start keying the preset unlocking code from the keyboard of the outside key telephone set. The keyed-in DTMF unlocking code will then be amplified by the operation amplifier U2 and fed into the decoding circuit 24 through sum amplifier 33 for being decoded into BCD signals and input into CPU 25 (it shall be appreciated that signals produced by the push-button keys of the key telephone set are DTMF signals). Finally, after the keyed-in unlocking code is compared and found to be identical with the preset unlocking code stored in RAM 28, unlocking operations will be effected through the first relay circuit 27, just as described in the above paragraph 1.

While I have illustrated and described my invention by means of a specific embodiment, it is to be understood that numerous changes and modifications may be made therein without departing from the spirit and scope of the invention as defined in appended claims.

What I claim is:

1. A DTMF-code controlled lock device comprising:

a key control means having a structure adapted for being carried by a user and including a first keyboard with a plurality of keys for being used to input preset unlocking DTMF code therefrom, a DTMF encoding circuit serving as a central part coupled with said first keyboard for encoding said unlocking DTMF code into mixed signals combined with two frequencies, and an amplifying circuit coupled with said DTMF encoding circuit for amplifying said mixed signals, and a sound generating means connected to said amplifying circuit for producing DTMF tone therefrom; and a lock-body control means adapted for being installed in a door together with a door lock, and including: a transducing means installed at a hidden place in a door for transferring said DTMF tone received from said sound generating means into DTMF signals; a tone amplifier and a sum amplifier connected in series with said transducing means for amplifying and combining said DTMF signals; a decoding circuit connected to said sum amplifier for decoding combined DTMF signals into BCD codes; a CPU having a plurality of memory units connected thereto coupled with said decoding circuit for storing preset unlocking codes and comparing with said BCD codes so as to output a high-level voltage therefrom if said BCD codes are found identical with preset unlocking codes; a first relay circuit connected between said CPU and a lock bolt for effecting unlocking operation according to said high-level voltage from said CPU; a telephone interfacing means having a transformer circuit for being electrically connected to a pair of telephone lines of a home key telephone set through a switch being used to connect said lock-body control means to the home telephone set, an amplifying circuit electrically connected to the input of said sum amplifier, a ringing detecting circuit coupled with said CPU for detecting and transmitting remote ringing signals to said CPU, and an electrical contact disposed in said transformer circuit for being actuated to close and open thereat; and a second relay circuit coupled between said CPU and the electrical contact of said transformer circuit for being energized by said CPU upon receiving a remote ringing signal so as to attract the electrical contact and close the circuit thereof; whereby, unlocking operation can be effected through the preset unlocking DTMF code keyed in either from said first keyboard or from a remote key telephone set by the user for achieving high security.

2. A DTMF-code controlled lock device according to claim 1 wherein said key control means further comprises an electrical connecting means with a pair of terminals provided for making electrical connections therewith; and said lock-body control means further comprises a pair of electrical contacts coupled with an input of said sum amplifier for being respectively connected to the terminals of said electrical connecting means; thereby, in case said transducing means is out of order, said electrical connecting means can be directly connected to said electrical contacts for performing unlocking operations through said first keyboard.

3. A DTMF-code controlled lock device according to claim 1 wherein said lock-body control means further comprises a second keyboard electrically coupled with said CPU for being used to set and change or modify said unlocking DTMF code therewith.

* * * * *